US005669255A

United States Patent [19]

Albano

[11] Patent Number: 5,669,255

[45] Date of Patent: Sep. 23, 1997

[54] ANTI-TAMPER LOCK GUARD

[76] Inventor: George Albano, 30 Comber St., Valley Stream, N.Y. 11580

[21] Appl. No.: 519,544

[22] Filed: Aug. 25, 1995

[51] Int. Cl.[6] ..... E05B 67/38

[52] U.S. Cl. ..... 70/56; 70/381; 70/417; 70/424; 70/455

[58] Field of Search ..... 70/54–56, 417, 70/423, 424, 427, 428, 455, DIG. 43, DIG. 56, 452, 381

[56] References Cited

U.S. PATENT DOCUMENTS

| | | | |
|---|---|---|---|
| 256,902 | 4/1882 | Kirk | 70/56 |
| 786,586 | 4/1905 | Moreland | 70/54 |
| 1,652,234 | 12/1927 | Bronson et al. | 70/417 |
| 2,856,220 | 10/1958 | Easley | 292/148 |
| 3,751,953 | 8/1973 | Newman | 70/381 |
| 3,820,360 | 6/1974 | Best | 70/417 X |
| 3,996,774 | 12/1976 | Best | 70/32 |
| 4,372,138 | 2/1983 | De Forrest | 70/56 |
| 4,760,720 | 8/1988 | Grille | 70/54 |
| 5,063,765 | 11/1991 | Squire et al. | 70/417 |
| 5,172,574 | 12/1992 | Perfetto | 70/56 |
| 5,469,722 | 11/1995 | Ellefson | 70/56 |

FOREIGN PATENT DOCUMENTS

| | | | |
|---|---|---|---|
| 2415184 | 9/1979 | France | 70/417 |
| 203530 | 9/1923 | United Kingdom | 70/55 |

*Primary Examiner*—Lloyd A. Gall
*Attorney, Agent, or Firm*—Myron Amer PC

[57] ABSTRACT

For a circular lock currently in popular use that is disposed in covering relation over lugs projected internally of the lock and consequently results in the holding of the lock stationary, an anti-tampering guard that encircles the lock and has a rotational degree of movement, so that a tampering tool must engage the guard interposed between the tool and the lock and any force applied by the tool merely results in harmless rotation of the guard rather than a twisting off of the lock-engaged lugs.

1 Claim, 1 Drawing Sheet

ANTI-TAMPER LOCK GUARD

The present invention generally relates to lock x security, and more particularly to improvements in the combined use of the popular keeper/hasp lug-protecting lock of the type disclosed in U.S. Pat. No. 3,769,821 and a guard disposed thereabout.

BACKGROUND OF THE INVENTION

1. Field of the Invention

The referenced patented lock is locked in place with the keeper/hasp lugs projected internally thereof to thereby obviate tampering removal of the lugs. The popularity of this patented lock is attested to by subsequent patented efforts to extend the security against tampering to the lock per se, as well as to the keeper/hasp lugs.

2. Description of the Prior Art

Thus, as exemplified by U.S. Pat. 5,172,574 issued to Ralph J. Perfetto on Dec. 22, 1992 entitled "Locking System Including a Customized Padlock Guard", the locked in place position of the lock over the keeper/hasp lugs is within a previously affixed guard in encircling relation about the lock which, by virtue of its interposed position between a tampering tool and the lock, minimizes the unauthorized non-key removal of the lock.

SUMMARY OF THE INVENTION

Previously affixed lock-protecting constructions designed specifically for the patented '821 lock are disclosed also in U.S. Pat. No. 3,834,195 issued to Wolfgang Winkhaus on Sep. 10, 1994, U.S. Pat. No. 4,372,138 issued to William E. DeForrest on Feb. 8, 1983, and U.S. Pat. No. 4,754,626 issued to Myron Siegel on Jul. 5, 1988.

While the lock-protecting devices of the aforesaid and all other known prior art efforts are generally effective for the purposes intended, each requires structure affixed in adjacent position to the keeper/hasp lugs to cooperate with the patented '821 lock, and this adds to the cost and preparation effort in the use of the lock.

It is generally an object of the present invention to provide a customized guard for a keeper/hasp lug-protecting lock overcoming the foregoing and other shortcomings of the prior art.

More particularly, it is an object to neutralize tampering efforts that might be attempted against the patented '821 lock in the provision of the within invention guard that denies access to the lock, but does not require prior affixation and, instead, is held in its operative position by the lock itself, all as will be explained in detail as the description proceeds.

BRIEF DESCRIPTION OF THE DRAWINGS

The description of the invention which follows, together with the accompanying drawings, should not be construed as limiting the invention to the example shown and described, because those skilled in the art to which this invention appertains will be able to devise other forms thereof within the ambit of the appended claims.

Figure 1:
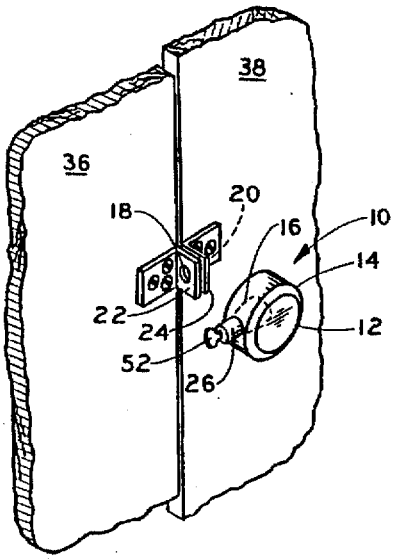
Fig. 1 PRIOR ART
FIGS. 1 and 2 are perspective views of a prior art lock incident to being placed into, and after assuming, its locked condition, for which the within inventive guard is provided to obviate tampering with this lock.

The within invention is an anti-tampering guard for a lock patented in U.S. Pat. 3,996,774 entitled "High Security Locking Mechanism" issued to Walter E. Best on Dec. 14, 1976 which, by this reference, is incorporated herein in its entirety and shown as "prior art" in FIGS. 1 and 2. As reference numeral-identified in the Best patent, the prior art patented lock 10 has a circular body 12 including starting, in a bottom wall closure 14 a rearwardly open chamber 16 to receive eyes 18 and 20 of a lug hasp 22 and a lug keeper 24 so that, as best shown in FIG. 1 of the Best patent, lock 10 has an operative locked condition in covering relation over the hasp and keeper lugs 22, 24 with a key-operated sliding bolt 26 projected through the eyes 18 and 20.

Figure 2:
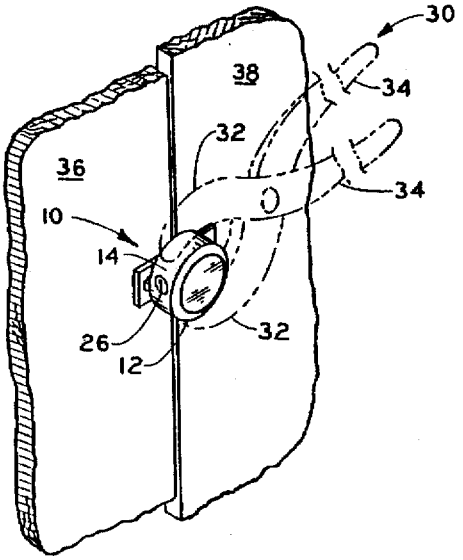
Fig. 2 PRIOR ART

An unavoidable consequence of the locked condition of lock 10, as shown in FIG. 2, is that it lacks, because bolt 26 is projected through the aligned openings 18, 20 of the stationary bolt-receiving members 22, 24, a rotative degree of movement. Stated otherwise, the bolt 26 projected through the eyes of members 22, 24 necessarily holds lock 10 against rotation. Thus, a tampering tool, such as long-handled pliers 30 as but one example, can have the jaws 32 thereof engaged about the lock 10 and, using the mechanical advantage afforded by the length of the handles 34, apply a rotative force that will twist the members 22, 24 from their positions on the locked-together panels 36 and 38.

Figure 3:
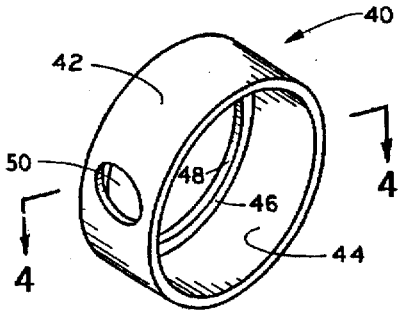
FIG. 3 is an isolated perspective view of the guard.
Figure 4:
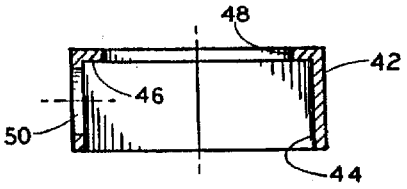
FIG. 4 is a sectional view taken along line 4—4 of FIG. 3.
Figure 5:
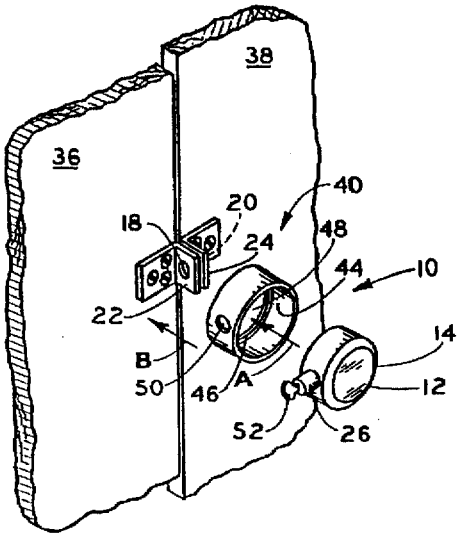
FIGS. 5 and 6 are perspective views similar to FIGS. 1 and 2, but illustrating use of the guard in protecting relation to the lock.
Figure 6:
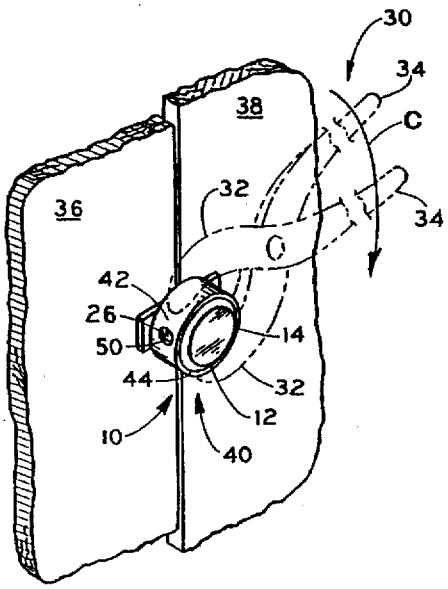

The tampering above described is obviated by the within inventive guard, generally designated 40, as illustrated in isolated perspective in FIGS. 3 and 4 and in use in FIGS. 5 and 6. More particularly, guard 40 has a circular body or wall 42 sized slightly larger in depth and circumferential extents than the lock circular body 12 which bounds a correspondingly slightly larger lock-protecting compartment 44 having an inturned flange 46 partially closing one end. Flange 46 has a central opening 48 of a selected larger diameter than the dimensions of the members 22, 24 so that for reasons subsequently to be explained, the members 22, 24 not only readily project through the opening 48 into the compartment 44 but guard 40 has clearance to rotate about the members 22, 24 because of the oversize of opening 48 relative to the members 22, 24.

Completing the construction of guard 40 which, in a preferred embodiment is of strong, non-crushable metal construction material, is an access opening 50 in the side wall 42 to the lock bolt 26.

In use, and as best shown in FIG. 5, the key-operated bolt 26 is urged in movement initially internally of lock 10, enabling lock 10 to be inserted within the guard compartment 44, and bolt 26 then withdrawn through opening 50, thus following the movement path depicted by the reference arrow A. The sub-assembly of lock and guard 10, 40 is then placed in covering movement B over the members 22, 24 and using the key 52, the bolt 26 projected through, and locked, in place in the aligned eyes 18, 20 of the members 22, 24 which extend into the lock chamber or compartment 16, thus assuming the condition depicted in FIG. 6. In this condition, guard 40 cannot be removed from its encircling relation about the lock 10 because such removal movement is prevented by the flange 46.

If it is again assumed that tampering is attempted using long-handled pliers or a similar tool 30, the jaws 32 engage the interposed wall 42 and any rotative movement C merely results in harmless rotation of the guard 40, in the running clearance provided between the oversized and undersized guard wall 42 and lock body 12 respectively, about the stationary lock 10 which, of course, obviates any twisting off of the lock 10.

While the lock guard herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for means temporarily rendered inseparable by a lock comprising adjacent lugs on said means adapted to be locked together, a guard for a lock consisting of a housing having a lock-receiving compartment bounded by a circular side wall, said side wall having opposite outer and inner edges, said outer edge bounding an opening into said lock-receiving compartment and said inner edge having an in-turned flange forming a partial closure for said lock-receiving compartment, said flange having a central opening sized to receive in projected relation therethrough said lugs, said guard having an operative position with said lugs projected into said lock-receiving compartment through said flange opening and a degree of rotative movement about said lugs, a lock having a face with a lug-receiving compartment therein, said lock having a circular shape sized to fit within said lock-receiving compartment and presenting a peripheral edge in adjacent position to a surface bounding said lock-receiving compartment, said lock having an operative position disposed within said guard lock-receiving compartment with said lugs projected within said lock lug-receiving compartment and adapted to be engaged by said lock such that said lock is inadvertently held stationary by said lugs and rendered vulnerable to twisting removal therefrom but without impeding said guard from partaking of rotative movement about said stationary-held lock, and said peripheral edge of said stationary-held lock having an operative position immediately forward of said guard in-turned flange so as to prevent removal of said guard from an encircling position about said lock, whereby said guard circular side wall is in an interposed position between said lock and a tampering tool attempted to be applied externally to said lock and any rotative movement using said tampering tool merely causes harmless rotation of said guard rather than a forced rotative movement of said stationary-held lock.

* * * * *